US009536631B1

(12) United States Patent
Riggs

(10) Patent No.: US 9,536,631 B1
(45) Date of Patent: Jan. 3, 2017

(54) SYSTEMS AND METHODS TO AVOID INSTABILITY CONDITIONS IN A SOURCE PLASMA CHAMBER

(71) Applicant: ASML Netherlands B.V., Veldhoven (NL)

(72) Inventor: Daniel Jason Riggs, San Diego, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 14/946,668

(22) Filed: Nov. 19, 2015

(51) Int. Cl.
*H05G 2/00* (2006.01)
*G21K 1/08* (2006.01)

(52) U.S. Cl.
CPC *G21K 1/08* (2013.01); *H05G 2/00* (2013.01); *H05G 2/003* (2013.01); *H05G 2/005* (2013.01); *H05G 2/008* (2013.01); *H05G 2/001* (2013.01)

(58) Field of Classification Search
CPC ..... H05G 2/00; H05G 2/001; H05G 2/003; H05G 2/005; H05G 2/008; G21K 1/08
USPC ..... 250/504 R
See application file for complete search history.

(56) References Cited

U.S. PATENT DOCUMENTS 8,598,552 B1 * 12/2013 Frihauf ..... H05G 2/005 250/504 R
8,958,143 B2 * 2/2015 Hou ..... H01S 3/076 250/504 R
2004/0195529 A1 * 10/2004 Hergenhan ..... H05G 2/008 250/504 R

* cited by examiner

*Primary Examiner* — Michael Maskell
(74) *Attorney, Agent, or Firm* — Gard & Kaslow LLP

(57) ABSTRACT

In LPP EUV systems, sinusoidal oscillations or instabilities can occur in the generated EUV energy. This is avoided by detecting when the LPP EUV system is approaching such instability and adjusting the LPP EUV system by moving the laser beam of the LPP EUV system. Detection is done by determining when the generated EUV energy is at or above a primary threshold. Adjusting the LPP EUV system by moving the laser beam is done for a fixed period of time, until a subsequently generated EUV energy is below the primary threshold, until a subsequently generated EUV energy is below the primary threshold for a fixed period of time, or until a subsequently generated EUV energy is at or below a secondary threshold below the primary threshold.

16 Claims, 10 Drawing Sheets

SYSTEMS AND METHODS TO AVOID INSTABILITY CONDITIONS IN A SOURCE PLASMA CHAMBER

BACKGROUND

Field

The present application relates generally to laser systems and, more specifically, to avoiding oscillation conditions in extreme ultraviolet light energy generated within a source plasma chamber.

Related Art

The semiconductor industry continues to develop lithographic technologies which are able to print ever-smaller integrated circuit dimensions. Extreme ultraviolet ("EUV") light (also sometimes referred to as soft x-rays) is generally defined to be electromagnetic radiation having wavelengths of approximately between 10 and 100 nm. EUV lithography is generally considered to include EUV light at wavelengths in the range of 10-14 nm, and is used to produce extremely small features (e.g., sub-32 nm features) in substrates such as silicon wafers. These systems must be highly reliable and provide cost-effective throughput and reasonable process latitude.

Methods to generate EUV light include, but are not necessarily limited to, converting a material into a plasma state that has one or more elements (e.g., xenon, lithium, tin, indium, antimony, tellurium, aluminum, etc.) with one or more emission line(s) in the EUV range. In one such method, often termed laser-produced plasma ("LPP"), the required plasma can be generated by irradiating a target material, such as a droplet, stream or cluster of material having the desired line-emitting element, with a laser beam at an irradiation site within an LPP EUV source plasma chamber.

FIG. 1 illustrates some of the components of an LPP EUV system 100. A laser source 101, such as a $CO_2$ laser, produces a laser beam 102 that passes through a beam delivery system 103 and through focusing optics 104 (comprising a lens and a steering mirror). Focusing optics 104 have a primary focus point 105 at an irradiation site within an LPP EUV source plasma chamber 110. A droplet generator 106 produces droplets 107 of an appropriate target material that, when hit by laser beam 102 at the primary focus point 105, generate a plasma which irradiates EUV light. An elliptical mirror ("collector") 108 focuses the EUV light from the plasma at a focal spot 109 (also known as an intermediate focus position) for delivering the generated EUV light to, e.g., a lithography scanner system (not shown). Focal spot 109 will typically be within a scanner (not shown) containing wafers that are to be exposed to the EUV light. In some embodiments, there may be multiple laser sources 101, with beams that all converge on focusing optics 104. One type of LPP EUV light source may use a $CO_2$ laser and a zinc selenide (ZnSe) lens with an anti-reflective coating and a clear aperture of about 6 to 8 inches.

For reference purposes, three perpendicular axes are used to represent the space within the plasma chamber 110, as illustrated in FIG. 1. The axis from the droplet generator 106 to the irradiation site 105 is defined as the x-axis (vertical in the example of FIG. 1); droplets 107 travel generally downward from the droplet generator 106 in the x-direction to irradiation site 105, although in some cases the trajectory of the droplets may not follow a straight line. The path of the laser beam 102 from focusing optics 104 to irradiation site 105 is defined as the z-axis (horizontal in the example of FIG. 1), and the laser beam 102 is moved or steered by the focusing optics 104 along the y-axis which is defined as the direction perpendicular to the x-axis and the z-axis.

In operation, the resulting EUV energy produced by the LPP EUV system 100 can experience oscillations which cause undesirable variations in wafer EUV light exposure. Further, a drifting of the focusing optics (caused by, for example, laser source power variation or focusing optics cooling water temperature variation) can cause the laser beam to slowly drift into a region of such oscillations. Rather than attempt to reduce or eliminate such oscillations, or directly address drifting focusing optics effects on laser beam positioning, what is needed is a way for the LPP EUV system 100 to continue operating by simply avoiding such issues.

SUMMARY

In one embodiment, a method comprises: detecting, by an energy detector, an amount of extreme ultraviolet (EUV) energy generated by a laser beam hitting a droplet of target material in a laser-produced plasma (LPP) EUV source plasma chamber of an LPP EUV system; detecting, by a system controller of the LPP EUV system, that the amount of EUV energy generated is approaching an unstable sinusoidal condition; and, directing, by the system controller to a focusing optic of the LPP EUV system, that the laser beam be moved along a Y-axis of the LPP EUV source plasma chamber.

In another embodiment, a laser-produced plasma (LPP) extreme ultraviolet (EUV) system comprises: a laser source configured to fire laser pulses at a primary focus point within an LPP EUV source plasma chamber of the LPP EUV system; an energy detector configured to detect an amount of EUV energy generated when one or more of the laser pulses hits a target material; and, a system controller configured to: detect that the amount of generated EUV energy is approaching an unstable sinusoidal condition; and, direct a focusing optic of the LPP EUV system move the laser beam along a Y-axis of the LPP EUV source plasma chamber.

In a further embodiment, is a non-transitory computer-readable storage medium having instructions embodied thereon, the instructions executable by one or more processors to perform operations comprising: detecting, by an energy detector, an amount of extreme ultraviolet (EUV) energy generated by a laser beam hitting a droplet of target material in a laser-produced plasma (LPP) EUV source plasma chamber of an LPP EUV system; detecting, by a system controller of the LPP EUV system, that the amount of EUV energy generated is approaching an unstable sinusoidal condition; and, directing, by the system controller to a focusing optic of the LPP EUV system, that the laser beam be moved along a Y-axis of the LPP EUV source plasma chamber.

DETAILED DESCRIPTION

In LPP EUV systems, the amount of EUV energy generated is maximized when a droplet arrives at a primary focus point at the same time as a pulse of a laser beam. Conversely, when the droplet and laser beam do not both arrive at the primary focus point at the same time, the droplet is not completely irradiated by the laser beam. When that occurs, the laser beam, instead of squarely hitting the droplet, may only hit a portion of the droplet or miss the droplet entirely. This results in a lower-than-expected level of EUV energy being generated from the droplet. Repeated instances of this can appear as oscillations or instabilities in the resulting EUV energy level. Similarly, other factors such as laser beam focusing drift caused drifting of the focusing optics of the LPP EUV system can likewise cause instabilities in the level of generated EUV energy.

Prior approaches to dealing with these problems have been directed towards stabilizing the oscillations, with mixed results. The present approach instead seeks to avoid or circumvent conditions which might cause the instabilities in EUV energy production. The present approach automatically detects when the LPP EUV system is approaching such instability and automatically makes adjusts to avoid it.

Figure 2:
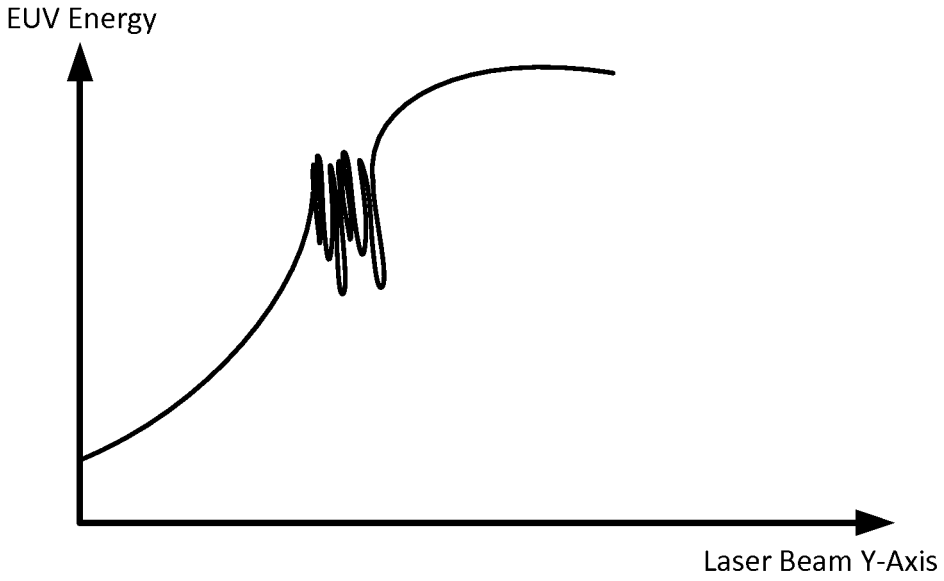
FIG. 2 is a graph showing an example of generated EUV energy versus location of the laser beam as it is moved along the Y-axis in an LPP EUV system

FIG. 2 is a graph showing generated EUV energy versus location of the laser beam as it is moved along the Y-axis (as explained with reference to FIG. 2). As can be seen, the generated EUV energy increases from a lower value to a higher value as the laser beam is moved along the Y-axis. However, as also shown in the figure, the generated EUV energy is not a smooth curve in that it experiences instabilities at some point or within some range along the curve. The present approach avoids these instabilities, according to several approaches as explained further elsewhere herein, by detecting when the LPP EUV system is approaching them and then making appropriate adjustments.

Figure 3A:
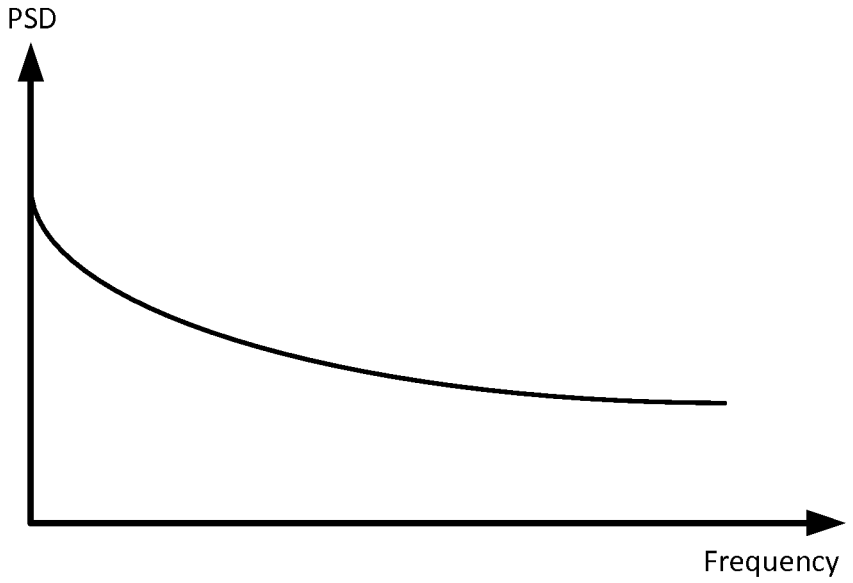
FIG. 3*a* is a Power Spectral Density graph which shows the strength of energy variations as a function of frequency.
Figure 3B:
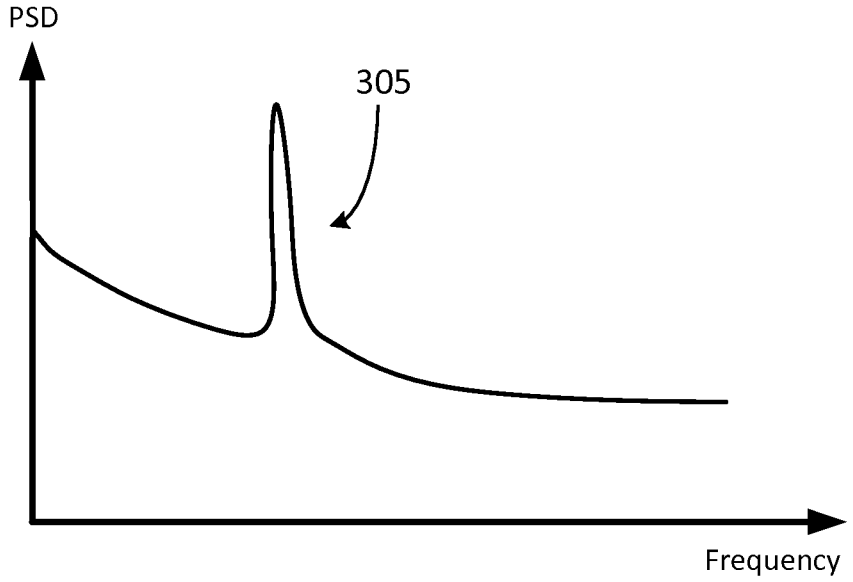
FIG. 3*b* is a Power Spectral Density graph which shows the strength of energy variations as a function of frequency now evidencing a sinusoidal instability.

FIG. 3*a* is a Power Spectral Density (PSD) graph which, as understood by one of skill in the art, shows the strength of energy variations as a function of frequency. In the graph, the PSD is shown steadily decreasing with increasing frequency. FIG. 3*b* is another graph of PSD versus frequency evidencing a sinusoidal instability via the large central energy spike 305 in the curve. Avoiding the instability is therefore a matter of first identifying the spike. A Kalman filter estimates a current condition based on a previous estimate and a current measurement modified by a gain factor, as is known in the art, and as will be understood by one of skill in the art in light of the teachings herein can be used to quickly identify the spike.

Figure 4A:
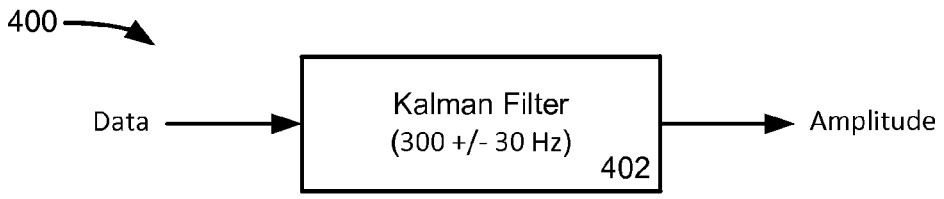
FIG. 4*a* is an example Kalman filter operating at a nominal frequency plus or minus some bandwidth (e.g., 300 plus or minus 30 Hz), according to an embodiment.
Figure 4B:
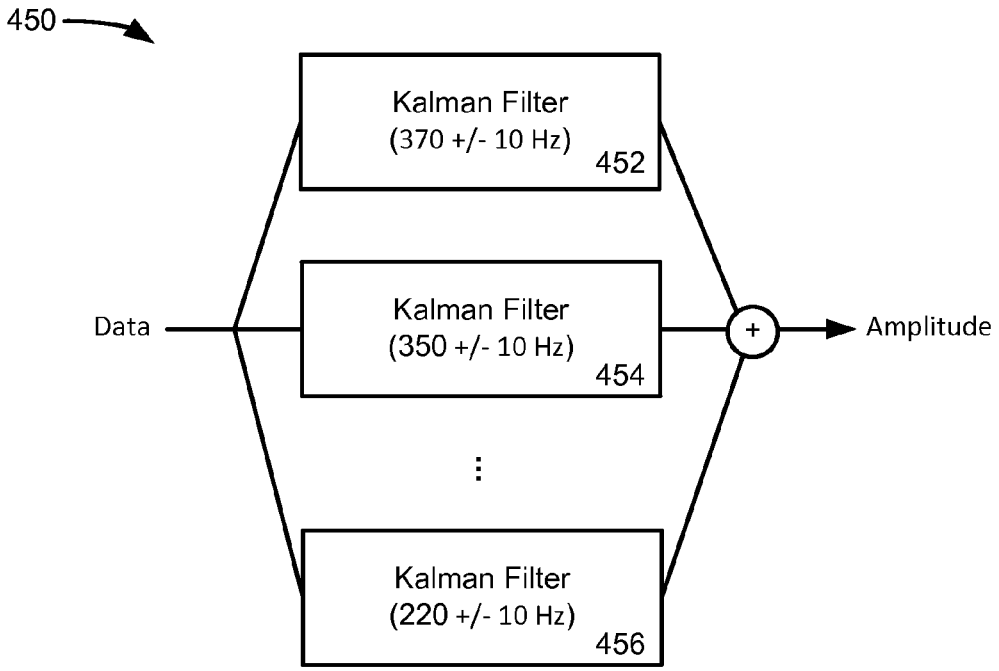
FIG. 4*b* is an example of multiple Kalman filters operating in parallel, each Kalman filter operating on a different frequency range, and where the output of each is summed to produce a weighted average of the multiple filters, according to an embodiment.

FIG. 4*a* is an example Kalman filter 402 operating at a nominal frequency plus or minus some bandwidth (in this example, 300 Hz plus or minus 30 Hz, i.e., 270 Hz to 330 Hz) which receives PSD data as input and provides an amplitude output for that frequency range. As such, this particular filter will provide an amplitude output when there is input PSD data in that frequency range of 270 Hz to 330 Hz. While 300 Hz may be the desirable nominal frequency to watch for instabilities in a given LPP EUV system, instabilities can also occur in neighboring frequencies. FIG. 4*b* is an example of multiple Kalman filters operating in parallel, each Kalman filter operating on a different frequency range (e.g., filter 452 operating on the range of 360 Hz to 380 Hz, filter 454 operating on the range of 340 Hz to 360 Hz, and filter 456 operating on the range of 210 Hz to 230 Hz, with other filters not shown but represented by the ellipses operating on the ranges in between 230 Hz and 340 Hz), and where the output of each filter is summed to produce a weighted average of the multiple filters thereby monitoring a broader range of frequencies (in this case 210 Hz to 380 Hz).

Figure 5:
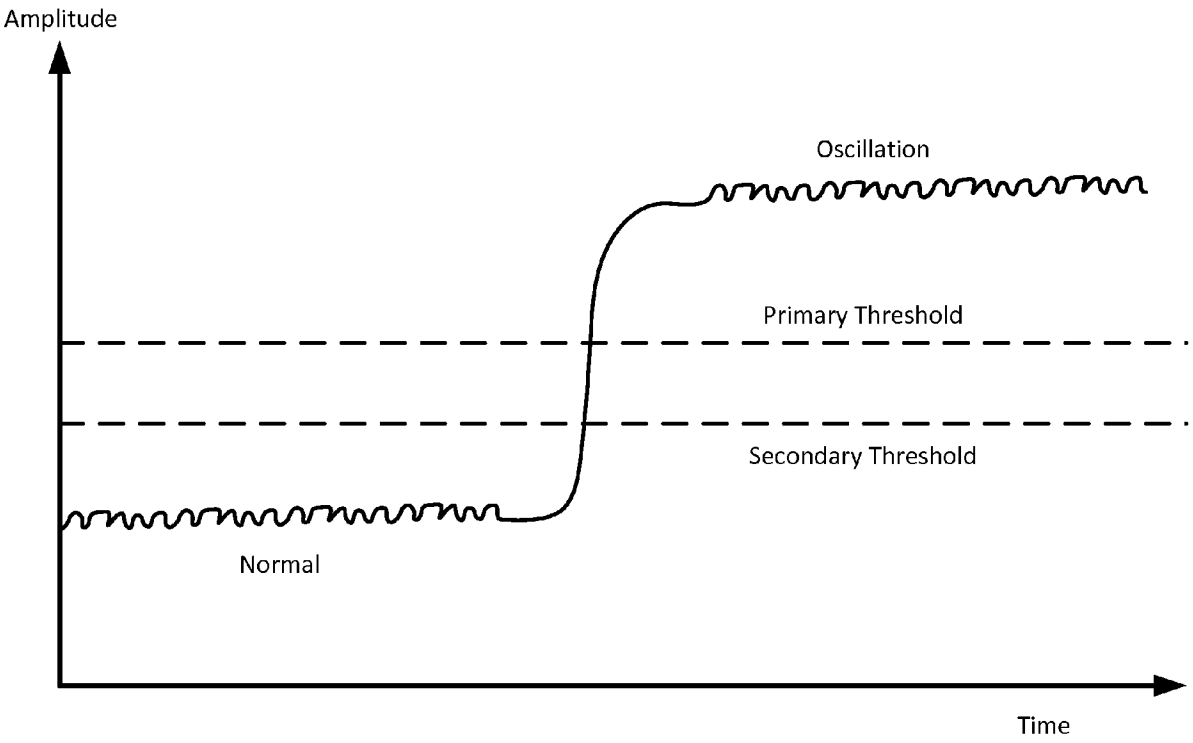
FIG. 5 is a graph of amplitude, output of one or more Kalman filter, over time.

FIG. 5 is a graph of amplitude, e.g., from the output of a Kalman filter as in FIG. 4*a* or the sum of the weighted average of multiple Kalman filters as in FIG. 4*b*, over time. As can be seen, in normal operation, the amplitude stays low and relatively stable until at some point in time it rises rapidly to an unstable, oscillation condition. It is this later unstable, oscillation operating condition that the present approach avoids.

Figure 1:
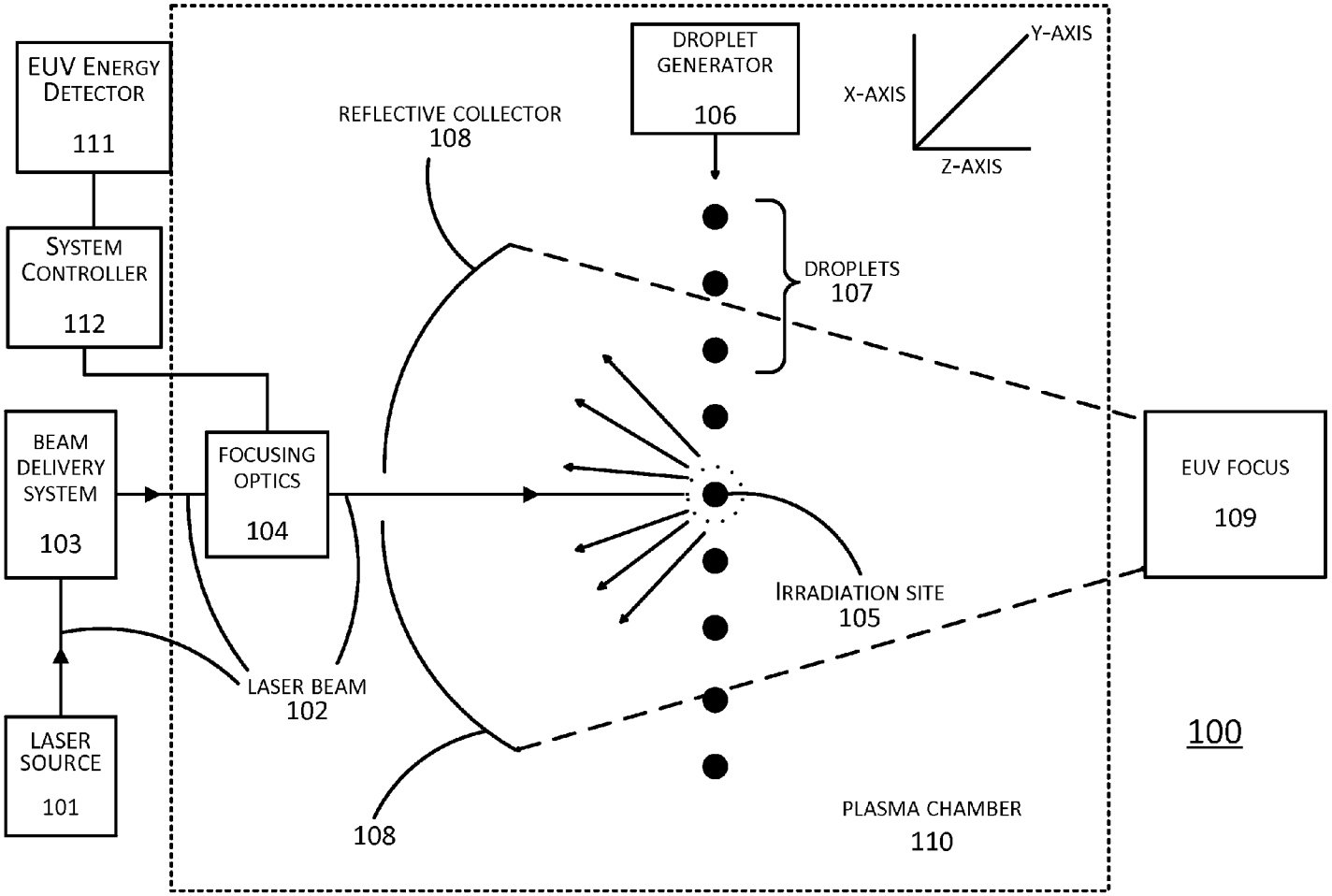
FIG. 1 is a diagram of a portion of an LPP EUV system.
Figure 6:
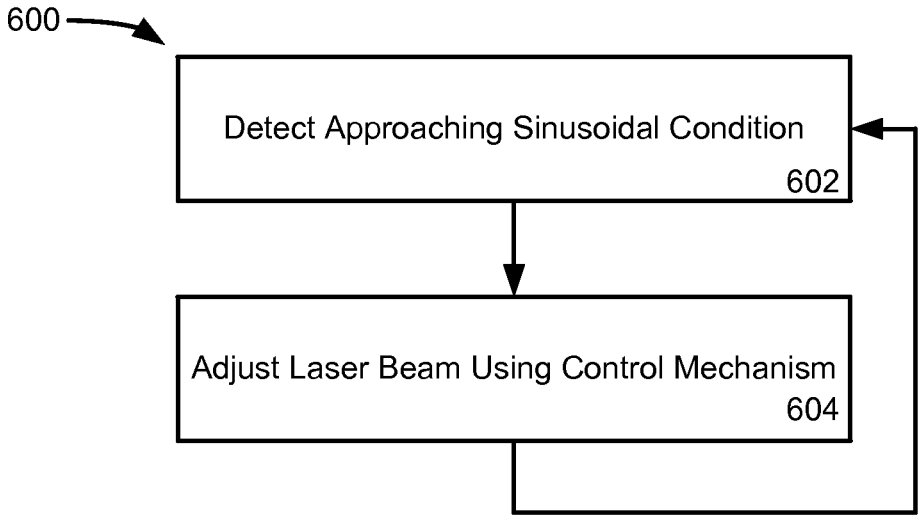
FIG. 6 is a flowchart of a method of avoiding instabilities in generated EUV energy in an LPP EUV system, according to one embodiment.

FIG. 6 is a flowchart of a method of avoiding instabilities in generated EUV energy in an LPP EUV system, such as system 100 of FIG. 1, according to one embodiment of the present approach in its most simplified form. In step 602 the approaching sinusoidal condition, the instability, is detected. This detection can be done in various ways as evidenced by the examples described elsewhere herein, and is done in one embodiment by EUV energy detector 111 of FIG. 1 detecting the generated EUV energy and System Controller 112 of FIG. 1 detecting that the generated EUV energy is approaching a sinusoidal instability condition. In step 604, the laser beam is adjusted using a control mechanism. This adjustment, made by moving the laser beam along the Y-axis, can be done in various ways as evidenced by the examples described elsewhere herein, and is done in one embodiment by System Controller 112 directing Focusing Optics 104 of FIG. 1 to move the laser beam along the Y-axis.

Figure 7:
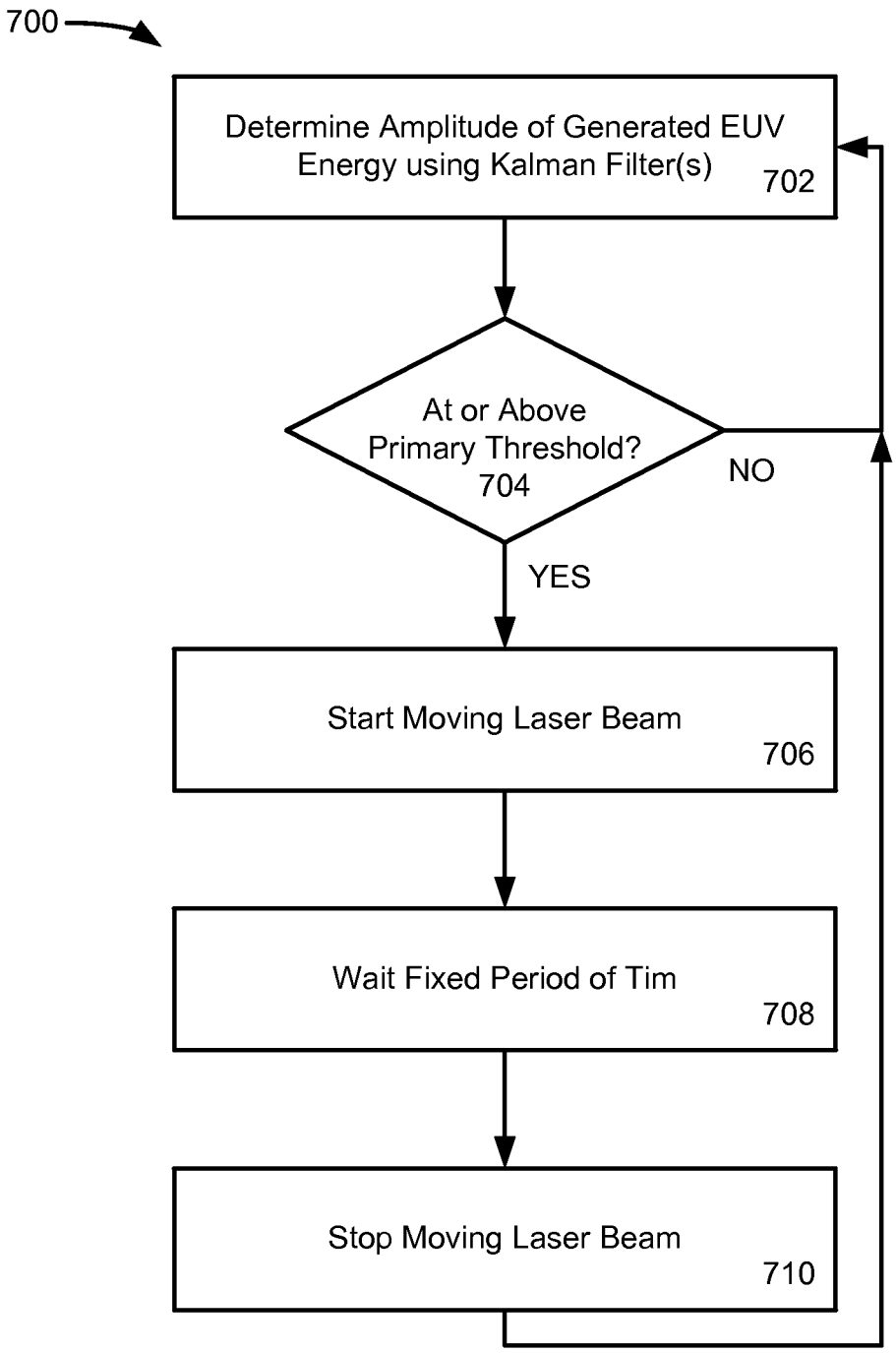
FIG. 7 is a flowchart of a method of avoiding instabilities in generated EUV energy in an LPP EUV system using Dwell Time Control, according to an embodiment.

FIG. 7 is a flowchart of a method of avoiding instabilities in generated EUV energy in an LPP EUV system, such as system 100 of FIG. 1, according to one embodiment of the present approach generally referred to herein as Dwell Time Control. In this embodiment, amplitude of the generated EUV energy is determined using one or more Kalman filters (e.g., those of FIG. 4*a* or 4*b*) based on output from EUV Energy Detector 111 of FIG. 1, in step 702. The amplitude is then compared to a primary threshold, in step 704, to determine if the amplitude is at or above (meets or exceeds) the primary threshold, e.g., by System Controller 112 of FIG. 1 in one embodiment. If the primary threshold has not been met or exceeded, indicating that the LPP EUV system is not yet approaching the unstable, oscillating condition, the process returns to step 702 to again determine the amplitude of the generated EUV energy.

Conversely, if the primary threshold has been met or exceeded, indicating that the LPP EUV system is approaching the unstable, oscillating condition, the process continues by moving the laser beam along the Y-axis for a fixed or predetermined period of time (the "dwell time" of the Dwell Time Control). In one embodiment, moving the laser beam for the fixed or predetermined period of time is accomplished by starting moving the laser beam along the Y-axis in step 706 (e.g. by System Controller 112 directing Focusing Optics 104 of FIG. 1 to begin moving Laser Beam 102 along the Y-axis), then waiting for the fixed or predetermined period of time in step 708 (e.g., by System Controller 112 of FIG. 1), and then stopping moving laser beam along the Y-axis in step 710 (e.g. by System Controller 112 directing Focusing Optics 104 of FIG. 1 to stop moving Laser Beam 102 along the Y-axis). The process then returns to step 702 as shown.

It is to be understood that, in light of the teachings herein, steps 702 and 704 are one example of step 602 of FIG. 6 while steps 706 through 710 are one example of step 604 of FIG. 6.

In one embodiment, the primary threshold is determined offline, that is, when the LPP EUV system is not otherwise being used to etch wafers in a production operation. Further, the primary threshold should preferably be set at a level above typical or normal machine amplitude variations (as shown in FIG. 5) and, further, should preferably be set low enough so as to ensure the instability or oscillations are avoiding using the approach described herein.

As would be understood by one of skill in the art in light of the teachings herein, the dwell time is based on slew speed of the beam steering mirrors because dwell time is the mirror slew rate divided by the mirror distance to move. Dwell time is therefore determined in a given implementation based on physical limitations (e.g., mirror slew rate) of the particular equipment used.

Figure 8:
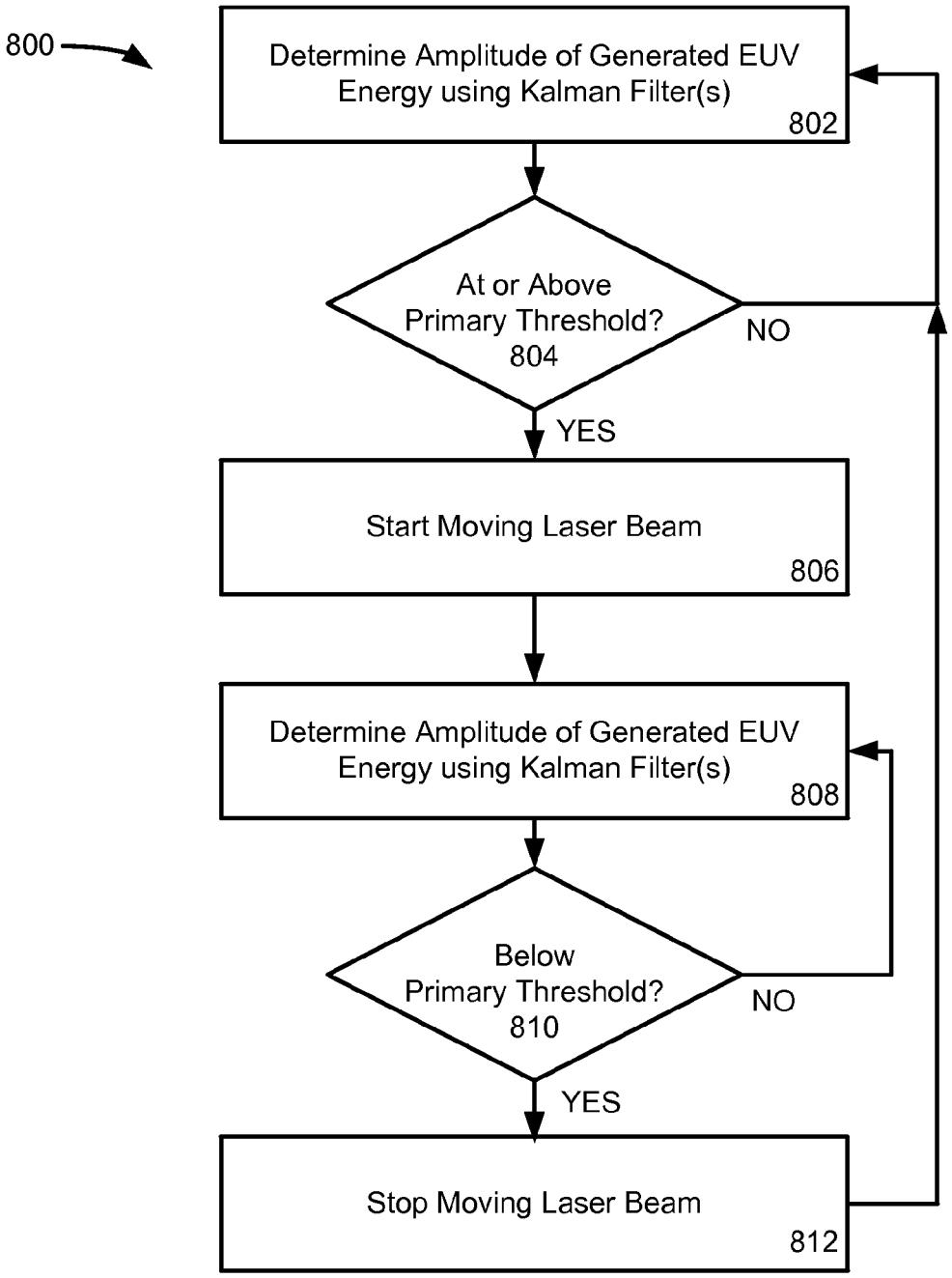
FIG. 8 is a flowchart of a method of avoiding instabilities in generated EUV energy in an LPP EUV system using Persistent Amplitude Feedback, according to an embodiment.

FIG. 8 is a flowchart of a method of avoiding instabilities in generated EUV energy in an LPP EUV system, such as system 100 of FIG. 1, according to one embodiment of the present approach generally referred to herein as Persistent Amplitude Feedback. In this embodiment, amplitude of the generated EUV energy is determined using one or more Kalman filters (e.g., those of FIG. 4*a* or 4*b*) based on output from EUV Energy Detector 111 of FIG. 1, in step 802. The amplitude is then compared to a primary threshold, in step 804, to determine if the amplitude is at or above (meets or exceeds) the primary threshold, e.g., by System Controller 112 of FIG. 1 in one embodiment.

If the primary threshold has not been met or exceeded, indicating that the LPP EUV system is not yet approaching the unstable, oscillating condition, the process returns to step 802 to again determine the amplitude of the generated EUV energy. Conversely, if the primary threshold has been met or exceeded, indicating that the LPP EUV system is approaching the unstable, oscillating condition, the process continues by starting moving the laser beam along the Y-axis in step 806. In one embodiment, starting moving the laser beam along the Y-axis in step 806 is accomplished by System Controller 112 directing Focusing Optics 104 of FIG. 1 to begin moving Laser Beam 102 along the Y-axis.

In step 808, the amplitude of the generated EUV energy is again determined typically using the same approach as in step 802, and the amplitude is again compared to the primary threshold, in step 810, to determine if the amplitude is below (does not meet or exceed) the primary threshold, e.g., by System Controller 112 of FIG. 1 in one embodiment. Steps 808 and 810 are therefore a feedback mechanism regarding the laser beam movement. If the primary threshold is still met or exceeded, indicating that the LPP EUV system is still approaching the unstable, oscillating condition, the process returns to step 808. Conversely, if the amplitude is below the primary threshold, indicating that the LPP EU system is no longer approaching the unstable, oscillating condition, the process continues by stopping moving the laser beam along the Y-axis in step 812. In one embodiment, stopping moving the laser beam along the Y-axis in step 812 is accomplished by System Controller 112 directing Focusing Optics 104 of FIG. 1 to stop moving Laser Beam 102 along the Y-axis. The process then returns to step 802 as shown.

It is to be understood that, in light of the teachings herein, steps 802 and 804 are one example of step 602 of FIG. 6 while steps 806 through 812 are one example of step 604 of FIG. 6.

Figure 9:
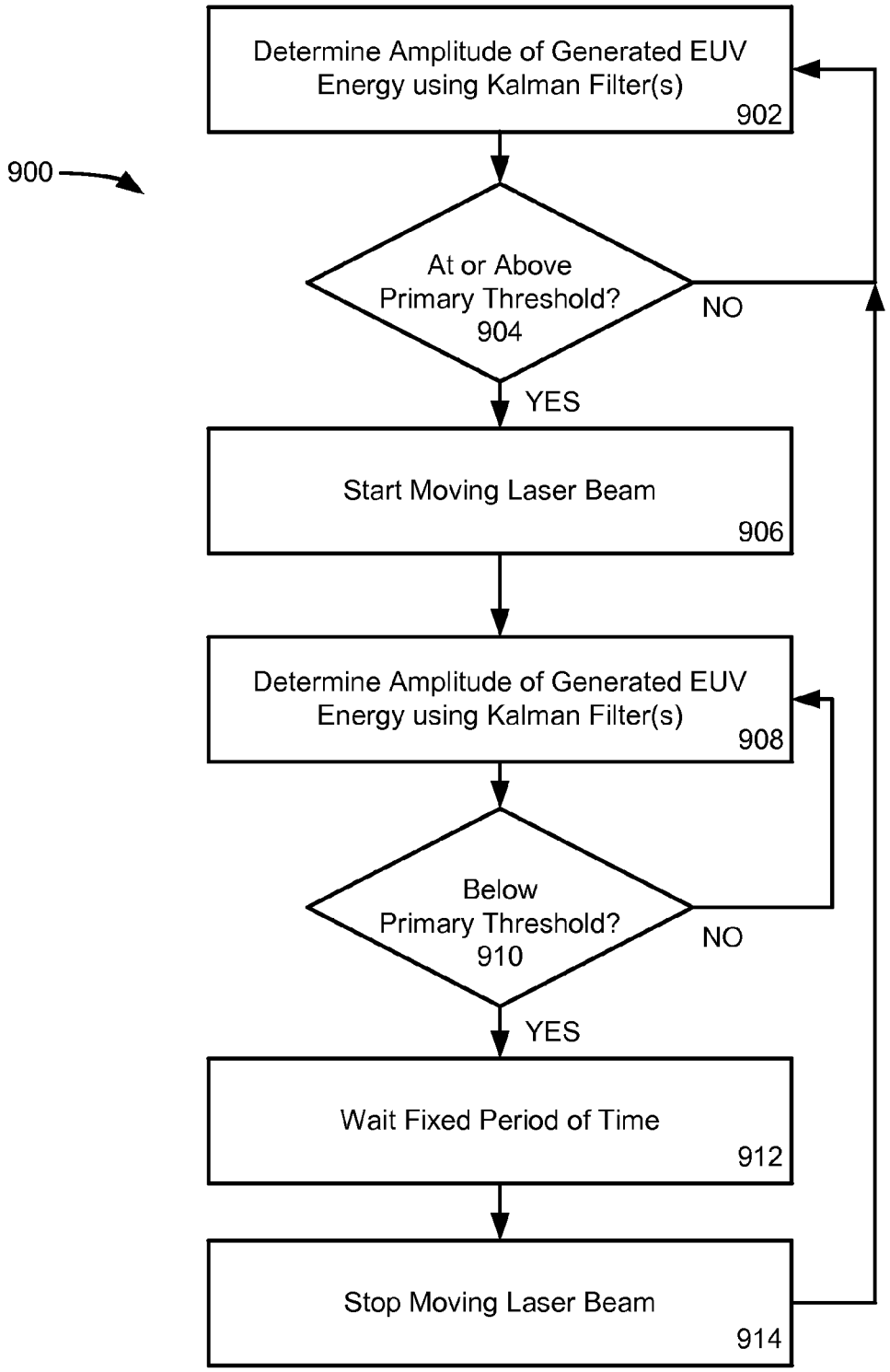
FIG. 9 is a flowchart of a method of avoiding instabilities in generated EUV energy in an LPP EUV system using Amplitude Feedback for a Fixed Period of Time, according to an embodiment.

FIG. 9 is a flowchart of a method of avoiding instabilities in generated EUV energy in an LPP EUV system, such as system 100 of FIG. 1, according to one embodiment of the present approach generally referred to herein as Amplitude Feedback for a Fixed Period of Time. In this embodiment, amplitude of the generated EUV energy is determined using one or more Kalman filters (e.g., those of FIG. 4*a* or 4*b*) based on output from EUV Energy Detector 111 of FIG. 1, in step 902. The amplitude is then compared to a primary threshold, in step 904, to determine if the amplitude is at or above (meets or exceeds) the primary threshold, e.g., by System Controller 112 of FIG. 1 in one embodiment.

If the primary threshold has not been met or exceeded, indicating that the LPP EUV system is not yet approaching the unstable, oscillating condition, the process returns to step 902 to again determine the amplitude of the generated EUV energy. Conversely, if the primary threshold has been met or exceeded, indicating that the LPP EUV system is approaching the unstable, oscillating condition, the process continues by starting moving the laser beam along the Y-axis in step 906. In one embodiment, starting moving the laser beam along the Y-axis in step 906 is accomplished by System Controller 112 directing Focusing Optics 104 of FIG. 1 to begin moving Laser Beam 102 along the Y-axis.

In step 908, the amplitude of the generated EUV energy is again determined typically using the same approach as in step 902 and, in step 910, the amplitude is again compared to the primary threshold to determine if the amplitude is below (does not meet or exceed) the primary threshold, e.g., by System Controller 112 of FIG. 1 in one embodiment. Steps 908 and 910 are therefore a feedback mechanism regarding the laser beam movement. If the primary threshold is still met or exceeded, indicating that the LPP EUV system is still approaching the unstable, oscillating condition, the process returns to step 908. Conversely, if the amplitude is below the primary threshold, indicating that the LPP EU system is no longer approaching the unstable, oscillating condition, the process continues by waiting for a fixed or predetermined period of time, in step 912, before stopping moving the laser beam along the Y-axis in step 914. The waiting that occurs in step 912 helps avoids simply oscillating around the primary threshold. In one embodiment, waiting for a fixed or predetermined period of time in step 912 is accomplished by System Controller 112 of FIG. 1 and stopping moving the laser beam along the Y-axis in step 914 is accomplished by System Controller 112 directing Focusing Optics 104 of FIG. 1 to stop moving Laser Beam 102 along the Y-axis. The process then returns to step 902 as shown.

It is to be understood that, in light of the teachings herein, steps 902 and 904 are one example of step 602 of FIG. 6 while steps 906 through 914 are one example of step 604 of FIG. 6.

Figure 10:
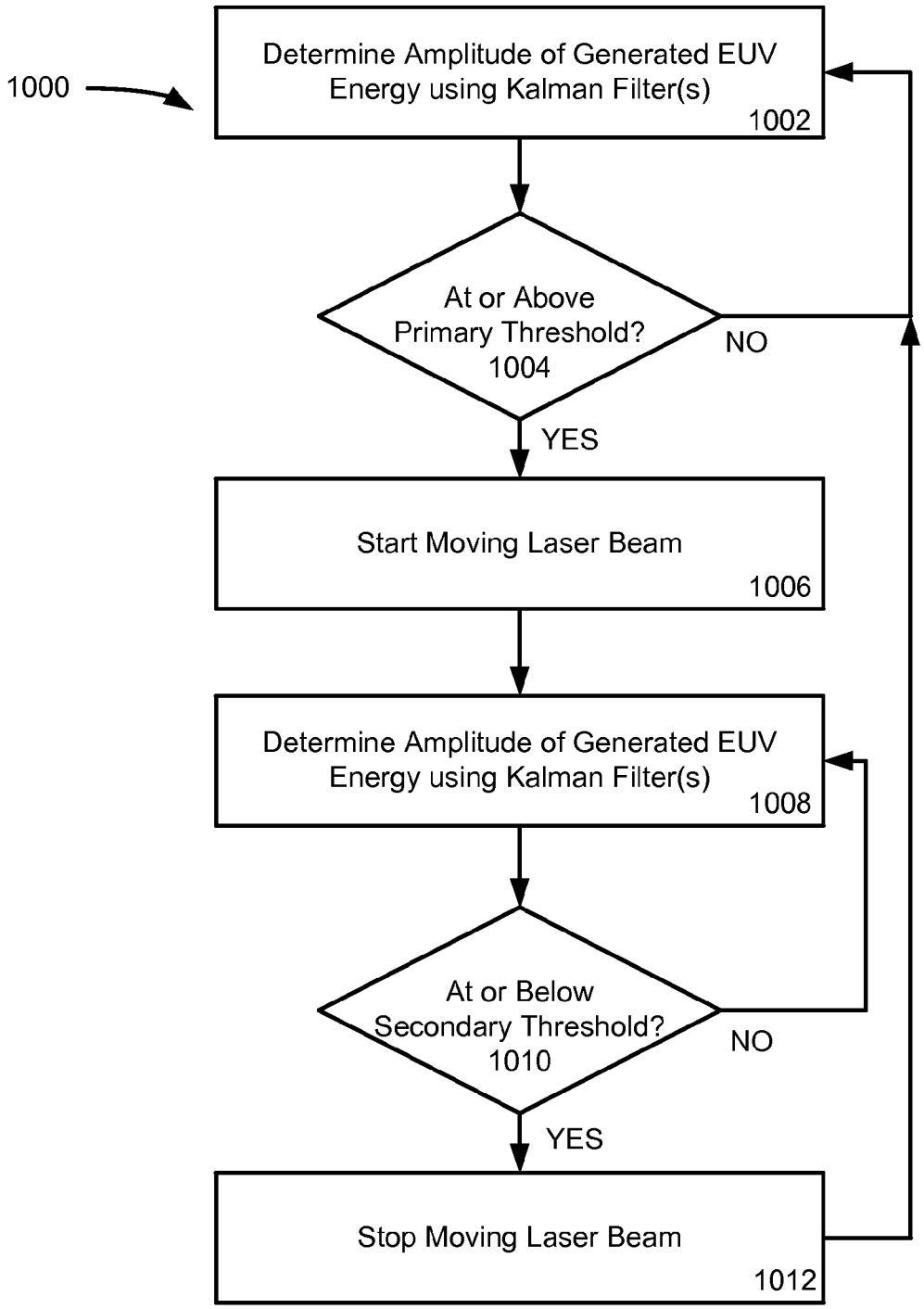
FIG. 10 is a flowchart of a method of avoiding instabilities in generated EUV energy in an LPP EUV system using Hysteresis Control, according to an embodiment.

FIG. 10 is a flowchart of a method of avoiding instabilities in generated EUV energy in an LPP EUV system, such as system 100 of FIG. 1, according to one embodiment of the present approach generally referred to herein as Hysteresis Control. In this embodiment, amplitude of the generated EUV energy is determined using one or more Kalman filters (e.g., those of FIG. 4*a* or 4*b*) based on output from EUV Energy Detector 111 of FIG. 1, in step 1002. The amplitude is then compared to a primary threshold, in step 1004, to determine if the amplitude is at or above (meets or exceeds) the primary threshold, e.g., by System Controller 112 of FIG. 1 in one embodiment.

If the primary threshold has not been met or exceeded, indicating that the LPP EUV system is not yet approaching the unstable, oscillating condition, the process returns to step 1002 to again determine the amplitude of the generated EUV energy. Conversely, if the primary threshold has been met or exceeded, indicating that the LPP EUV system is approaching the unstable, oscillating condition, the process continues by starting moving the laser beam along the Y-axis in step 1006. In one embodiment, starting moving the laser beam along the Y-axis in step 1006 is accomplished by System Controller 112 directing Focusing Optics 104 of FIG. 1 to begin moving Laser Beam 102 along the Y-axis.

In step 1008, the amplitude of the generated EUV energy is again determined typically using the same approach as in step 1002 and, in step 1010, the amplitude is compared to a secondary threshold to determine if the amplitude is at or below the secondary threshold, e.g., by System Controller 112 of FIG. 1 in one embodiment. If the primary threshold is not at or below the secondary threshold, indicating that the LPP EUV system is not yet far enough away from approaching the unstable, oscillating condition, the process returns to step 1008. Conversely, if the amplitude is at or below the secondary threshold, indicating that the LPP EU system is far enough away from approaching the unstable, oscillating condition then the process continues by stopping moving the laser beam along the Y-axis in step 1012. Determining in step 1010 that the amplitude is at or below the secondary threshold ensures that the amplitude does not simply oscillate around the primary threshold. In one embodiment, stopping moving the laser beam along the Y-axis in step 1012 is accomplished by System Controller 112 directing Focusing Optics 104 of FIG. 1 to stop moving Laser Beam 102 along the Y-axis. The process then returns to step 1002 as shown.

It is to be understood that, in light of the teachings herein, steps 1002 and 1004 are one example of step 602 of FIG. 6 while steps 1006 through 1012 are one example of step 604 of FIG. 6.

The disclosed method and apparatus has been explained above with reference to several embodiments. Other embodiments will be apparent to those skilled in the art in light of this disclosure. Certain aspects of the described method and apparatus may readily be implemented using configurations other than those described in the embodiments above, or in conjunction with elements other than those described above. For example, different algorithms and/or logic circuits, perhaps more complex than those described herein, may be used.

Further, it should also be appreciated that the described method and apparatus can be implemented in numerous ways, including as a process, an apparatus, or a system. The methods described herein may be implemented by program instructions for instructing a processor to perform such methods, and such instructions recorded on a non-transitory computer readable storage medium such as a hard disk drive, floppy disk, optical disc such as a compact disc (CD) or digital versatile disc (DVD), flash memory, etc., or communicated over a computer network wherein the program instructions are sent over optical or electronic communication links. It should be noted that the order of the steps of the methods described herein may be altered and still be within the scope of the disclosure.

It is to be understood that the examples given are for illustrative purposes only and may be extended to other implementations and embodiments with different conventions and techniques. While a number of embodiments are described, there is no intent to limit the disclosure to the embodiment(s) disclosed herein. On the contrary, the intent is to cover all alternatives, modifications, and equivalents apparent to those familiar with the art.

In the foregoing specification, the invention is described with reference to specific embodiments thereof, but those skilled in the art will recognize that the invention is not limited thereto. Various features and aspects of the above-described invention may be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. A method comprising:

detecting, by an energy detector, an amount of extreme ultraviolet (EUV) energy generated by a laser beam hitting a droplet of target material in a laser-produced plasma (LPP) EUV source plasma chamber of an LPP EUV system;

detecting, by a system controller of the LPP EUV system, that the amount of EUV energy generated is approaching an unstable sinusoidal condition; and, directing, by the system controller to a focusing optic of the LPP EUV system, that the laser beam be moved along a Y-axis of the LPP EUV source plasma chamber.

2. The method of claim 1, wherein detecting that the amount of generated EUV energy is approaching an unstable sinusoidal condition comprises determining that the detected amount of EUV energy generated is at or above a primary threshold.

3. The method of claim 2, wherein the primary threshold is set at a value between a normal operating level of EUV energy and a higher, unstable sinusoidal level of EUV energy.

4. The method of claim 1, wherein directing that the laser beam be moved along the Y-axis of the LPP EUV source plasma chamber comprises:

directing that the laser beam start moving along the Y-axis;

waiting a period of time; and, directing that the laser beam stop moving along the Y-axis.

5. The method of claim 1, wherein directing that the laser beam be moved along the Y-axis of the LPP EUV source plasma chamber comprises:

directing that the laser beam start moving along the Y-axis;

detecting, by the extreme ultraviolet (EUV) energy detector, a subsequent amount of EUV energy generated by a subsequent laser beam hitting a subsequent droplet of target material in the laser-produced plasma (LPP) EUV source plasma chamber of the LPP EUV system;

detecting that the subsequent amount of EUV energy generated is no longer approaching an unstable sinusoidal condition by determining that the subsequent amount of EUV energy generated is below the primary threshold; and, directing that the laser beam stop moving along the Y-axis.

6. The method of claim 1, wherein directing that the laser beam be moved along the Y-axis of the LPP EUV source plasma chamber comprises:

directing that the laser beam start moving along the Y-axis;

detecting, by the extreme ultraviolet (EUV) energy detector, a subsequent amount of EUV energy generated by a subsequent laser beam hitting a subsequent droplet of target material in the laser-produced plasma (LPP) EUV source plasma chamber of the LPP EUV system;

detecting that the subsequent amount of EUV energy generated is no longer approaching an unstable sinusoidal condition by determining that the subsequent amount of EUV energy generated is below the primary threshold;

waiting a period of time; and, directing that the laser beam stop moving along the Y-axis.

7. The method of claim 1, wherein directing that the laser beam be moved along the Y-axis of the LPP EUV source plasma chamber comprises:

directing that the laser beam start moving along the Y-axis;

detecting, by the extreme ultraviolet (EUV) energy detector, a subsequent amount of EUV energy generated by a subsequent laser beam hitting a subsequent droplet of target material in the laser-produced plasma (LPP) EUV source plasma chamber of the LPP EUV system;

detecting that the subsequent amount of EUV energy generated is no longer approaching an unstable sinusoidal condition by determining that the subsequent amount of EUV energy generated is at or below a secondary threshold; and, directing that the laser beam stop moving along the Y-axis.

8. The method of claim 1, wherein the secondary threshold is set at a value between a normal operating level of EUV energy and the primary threshold.

9. A laser-produced plasma (LPP) extreme ultraviolet (EUV) system comprising:

a laser source configured to fire laser pulses at a primary focus point within an LPP EUV source plasma chamber of the LPP EUV system;

an energy detector configured to detect an amount of EUV energy generated when one or more of the laser pulses hits a target material; and, a system controller configured to:

detect that the amount of generated EUV energy is approaching an unstable sinusoidal condition; and, direct a focusing optic of the LPP EUV system move the laser beam along a Y-axis of the LPP EUV source plasma chamber.

10. The system of claim 9, wherein the system controller configured to detect that the amount of generated EUV energy is approaching an unstable sinusoidal condition comprises detecting that the amount of generated EUV energy is at or above a primary threshold.

11. The system of claim 10, wherein the primary threshold is set at a value between a normal operating level of generated EUV energy and a higher, unstable sinusoidal level of generated EUV energy.

12. The system of claim 9, wherein the system controller configured to direct the focusing optic of the LPP EUV system to move the laser beam comprises:

directing the focusing optic to start moving the laser beam along the Y-axis;

detecting that a subsequent amount of generated EUV energy, as detected by the EUV energy detector, is no longer approaching an unstable sinusoidal condition by determining that the subsequent amount of generated EUV energy is below the primary threshold; and, directing the focusing optic to stop moving the laser beam along the Y-axis.

13. The system of claim 9, wherein the system controller configured to direct the focusing optic of the LPP EUV system to move the laser beam comprises:

directing the focusing optic to start moving the laser beam along the Y-axis;

detecting that a subsequent amount of generated EUV energy, as detected by the EUV energy detector, is no longer approaching an unstable sinusoidal condition by determining that the subsequent amount of generated EUV energy is below the primary threshold;

waiting a period of time; and, directing the focusing optic to stop moving the laser beam along the Y-axis.

14. The system of claim 9, wherein the system controller configured to direct the focusing optic of the LPP EUV system to move the laser beam comprises:

directing the focusing optic to start moving the laser beam along the Y-axis;

detecting that a subsequent amount of generated EUV energy, as detected by the EUV energy detector, is no longer approaching an unstable sinusoidal condition by determining that the subsequent amount of generated EUV energy is at or below a secondary threshold; and, directing the focusing optic to stop moving the laser beam along the Y-axis.

15. The system of claim 14, wherein the secondary threshold is set at a value between a normal operating level of EUV energy and the primary threshold.

16. A non-transitory computer-readable storage medium having instructions embodied thereon, the instructions executable by one or more processors to perform operations comprising:

detecting, by an energy detector, an amount of extreme ultraviolet (EUV) energy generated by a laser beam hitting a droplet of target material in a laser-produced plasma (LPP) EUV source plasma chamber of an LPP EUV system;

detecting, by a system controller of the LPP EUV system, that the amount of EUV energy generated is approaching an unstable sinusoidal condition; and, directing, by the system controller to a focusing optic of the LPP EUV system, that the laser beam be moved along a Y-axis of the LPP EUV source plasma chamber.

* * * * *